US008881424B2

(12) United States Patent
Lenoir et al.

(10) Patent No.: US 8,881,424 B2
(45) Date of Patent: Nov. 11, 2014

(54) DRYING INSTALLATION

(75) Inventors: Patrick Lenoir, Villeneuve d'Ascq (FR); Jerome Bellou, Vieille-Chapelle (FR)

(73) Assignee: Solaronics S.A., Armentières (FR)

( * ) Notice: Subject to any disclaimer, the term of this patent is extended or adjusted under 35 U.S.C. 154(b) by 250 days.

(21) Appl. No.: 13/634,739

(22) PCT Filed: Jan. 21, 2011

(86) PCT No.: PCT/EP2011/050841

§ 371 (c)(1),
(2), (4) Date: Sep. 13, 2012

(87) PCT Pub. No.: WO2011/113631

PCT Pub. Date: Sep. 22, 2011

(65) Prior Publication Data

US 2013/0019490 A1 Jan. 24, 2013

(30) Foreign Application Priority Data

Mar. 15, 2010 (EP) ..... 10156456

(51) Int. Cl.
*F26B 19/00* (2006.01)
*F26B 21/04* (2006.01)
*F26B 17/26* (2006.01)

(52) U.S. Cl.
CPC ..... *F26B 21/04* (2013.01); *F26B 2200/18* (2013.01); *F26B 17/26* (2013.01)
USPC ..... 34/381; 34/267; 34/90; 34/218; 431/329; 48/197 R; 432/222

(58) Field of Classification Search
USPC ..... 34/266, 267, 270, 380, 381, 90, 104, 34/201, 218; 431/328, 329; 48/89, 197 R; 432/210, 222
See application file for complete search history.

(56) References Cited

U.S. PATENT DOCUMENTS

| | | | | |
|---|---|---|---|---|
| 4,050,900 | A * | 9/1977 | Hobbs et al. | 422/605 |
| 4,740,158 | A * | 4/1988 | Johnson | 432/59 |
| 5,046,944 | A | 9/1991 | Smith | |
| 5,634,281 | A | 6/1997 | Nugent | |
| 5,974,688 | A | 11/1999 | Domingue et al. | |
| 6,412,190 | B1 * | 7/2002 | Smith | 34/266 |
| 7,926,200 | B2 * | 4/2011 | Lenoir | 34/266 |
| 8,046,934 | B2 * | 11/2011 | Lenoir | 34/613 |
| 8,690,975 | B2 * | 4/2014 | Tsangaris et al. | 48/61 |
| 2007/0295701 | A1 * | 12/2007 | Bodroghkozy et al. | 219/121.52 |
| 2010/0270015 | A1 * | 10/2010 | Vinegar et al. | 166/272.1 |

(Continued)

FOREIGN PATENT DOCUMENTS

| | | | |
|---|---|---|---|
| CA | 2267735 | C * | 2/2002 |
| FR | 2 875 721 | A1 | 3/2006 |

(Continued)

*Primary Examiner* — Steve M Gravini
(74) *Attorney, Agent, or Firm* — Foley & Lardner LLP

(57) ABSTRACT

A drying installation (1) and method for drying of products (3). More in particular, the invention relates to a drying installation (1) and a method for drying sludge or mud, as e.g. the drying of wastewater and industrial sludge possibly contaminated with toxic or corrosive components. The dryer installation (1) comprises infrared emitters (5) which are protected and/or insulated from the evaporation products (7) exiting the drying product (3).

12 Claims, 3 Drawing Sheets

(56) References Cited

U.S. PATENT DOCUMENTS

| | | | | |
|---|---|---|---|---|
| 2011/0036014 | A1* | 2/2011 | Tsangaris et al. | 48/62 R |
| 2011/0146155 | A1* | 6/2011 | Bentzen | 48/89 |
| 2013/0019490 | A1* | 1/2013 | Lenoir et al. | 34/90 |

FOREIGN PATENT DOCUMENTS

| | | | | | |
|---|---|---|---|---|---|
| JP | 2002364832 | A | * | 12/2002 | F23L 1/00 |
| WO | WO 2006/010693 | A1 | | 3/2006 | |
| WO | WO 2007/076594 | A1 | | 7/2007 | |

* cited by examiner

DRYING INSTALLATION

TECHNICAL FIELD

The present invention relates to a drying installation and a method for drying of products.

More in particular, the invention relates to a drying installation and a method for drying sludge or mud, as e.g. the drying of wastewater and industrial sludge.

The invention further relates to a drying installation and a method for drying such sludge or mud contaminated with toxic or corrosive components.

BACKGROUND ART

In the field of municipal and industrial wastewater disposal, it is necessary to treat the resulting wastewater sludge by heating to reduce the sludge volume by reducing its water content by evaporation and to reduce the sludge borne pathogens and its potential for vector attraction. Moreover, such sludge can contain toxic and/or corrosive components which must be removed in an economic and environmentally safe way. Thermal drying of this sludge has emerged as one of the preferred treatment methods. In many instances, infrared heaters are used as they are the most energy efficient as it results in lower heat losses during the transfer and a substantially smaller air emission control system.

An example of a sludge dryer is described in U.S. Pat. No. 5,974,688. This dryer installation is monitoring and regulating the temperature of the material to be dried and also monitors and regulates the temperature of the dryer itself. The monitoring system allows the material drying efficiency of the dryer to be maximized and at the same time reduces the risk of occurrence of combustion and damage to the dryer and its components due to temperature induced expansion and fatigue.

Another example of a dryer of wastewater, which can also be used to dry sludge, is described in FR 2875721. This system is using infrared radiation to dry a moving amount of wastewater.

U.S. Pat. No. 5,046,944 discloses a gas-fired burner with porous ceramic face through which gaseous combustion mixture emerges and on the emerging surface of which the mixture burns. The gas-fired burner can heat a substrate with help of streams of air or recycled combusted gas which is sweeping across the substrate to help remove moisture or other volatiles from the substrate. The gas-fired burner can be used for heat-treating moving webs carrying volatilizable material that contaminates the atmosphere if merely discharged into the air. U.S. Pat. No. 5,046,944 contains an example where the combustion gas and the volatilized material of the dried web are completely separated by means of a thin sheet of infra-red-transmitting material such as quartz.

DISCLOSURE OF INVENTION

The present invention provides a drying installation and a method for drying a product.

In a preferred embodiment, the present invention provides a drying installation and a method for drying sludge and mud, wherein the drying is performed in an economically and ecologically effective way.

An aspect of the claimed invention provides a dryer installation for drying a product, wherein the dryer installation comprises a device for moving the product and at least one heating unit. The heating unit comprises at least one infrared emitter and an overpressure system. The heating unit is adapted for heating the moving product by radiation. By this radiation, evaporation products are obtained. The heating unit is delimited by a protection. The protection is transparent to infrared radiation and provides a physical barrier against the evaporation products. The overpressure system is adapted for blowing air into the heating unit for creating an overpressure in the heating unit. This air is preferably at a temperature of about 200° C. The at least one infrared emitter is adapted for producing combustion products at high temperature. The air and these combustion products are getting mixed in the heating unit thereby obtaining a mixture. The protection is adapted for allowing a first flow of this mixture to exit the heating unit through the protection, under the driving force of the overpressure system, onto the substrate which is to be dried. This first flow is preferably ranging between 5 and 20% and more preferably 10% of the total amount of the mixture. The protection can be provided with perforations or the protection can be constructed such that it comprises different smaller protections which are not bound in an airtight way. Preferably, the perforations or the smaller protections which are not bound in an airtight way are spread over the surface of the protection. In an even more preferred way, the perforations or the smaller protections which are not bound in an airtight way are spread uniformly over the surface of the protection. The protection is preferably made at least partly of quartz glass, but similar products may be used as well. The overpressure system is adapted for removing the remainder of the mixture in a second flow out of the heating unit. The dryer installation further comprises an extraction means adapted for extracting extracted products. These extracted products comprise at least part of the evaporation products, which were produced by the heating of the product, and the first flow of the mixture originating from the heating unit.

The heating unit, being protected from the evaporation products by the protection and by the first flow of mixture exiting the heating unit under the driving force of the overpressure system, will therefore not come in contact with possible corrosive or even aggressive evaporation products which might corrode the radiant emitters or other components of the heating unit, such as e.g. fans or supply tubing. This is advantageous for the life-time of the drying system.

The first flow—a mixture of air and combustion products—is exiting the heating unit through the protection under the driving force of the overpressure system. This first flow is flowing perpendicularly onto the substrate to be dried. Hence, this first flow is assisting in the drying operation via an effective convective action. As this first flow is distributed over the full surface of the protection, a highly efficient use of this first flow is being made in supporting the drying operation in an efficient and even way over the full width of the drying installation. As this first flow is immediately flowing through the protection and perpendicularly onto the substrate, the loss of thermal energy of this first flow is minimal, maximizing its effective use for convective drying.

As the heating unit is also removing the remainder of the mixture in a second flow, the volume of gas extracted by the extraction means is smaller than in a conventional system which would need to extract all of the mixture produced by the heating unit. The present invention therefore also reduces the volume of extracted products to be post-treated.

It is a further benefit of the invention that two gaseous flows are evacuated separately out of the drying installation. It means that drying installations according to the invention can be built in such a way, to use or treat the two evacuated flows in the best suitable way inside or outside the drying installation; thereby optimizing the energy efficiency and reducing the total cost of operation of the drying installation.

The product to be dried can be mud or sludge, but also waste water, originating from industrial and municipal waste disposal.

The device for moving the product can e.g. be a conveyer belt or a vibrating plate or multiplicity of vibrating plates which are at an angle with reference to the horizontal plane.

In a preferred embodiment of the present invention, the extracted products are burned by an external burner, e.g. a flare system. This is especially suitable if the product to be dried gives rise to environmentally harmful evaporation products, and even aggressive and corrosive evaporation products.

In a preferred embodiment the heating unit comprises gas infrared burners. More preferably, these gas infrared burners are adapted to burn biogas originating from municipal or industrial waste disposal.

In another preferred embodiment, the dryer installation further comprises a recirculation means for providing the extracted products to at least one infrared emitter in at least one heating unit. The heat treatment of the evaporation products in the extracted products is then performed by the drying installation itself. The heat generated by combustion of the evaporation products is thus also used to heat the product to be dried. This lowers the amount of heat exposed to the environment and at the same time the toxic evaporation products are converted to harmless combustion products such as e.g. $CO_2$ and $H_2O$. In case of aggressive and/or corrosive extraction products, the emitters used to burn off the extracted products are adapted for receiving such aggressive and/or corrosive products.

In still another preferred embodiment, the dryer installation further comprises means for re-using at least part of the second flow of the mixture removed by the overpressure system for heating at least part of the device for moving the product. This is a further increase of the efficiency by the re-use of the hot flux gas. Preferably, this heating is done in the first part of the device for moving the product, as there the product will contain still a lot of fluid which needs to be evaporated.

Another aspect of the present invention provides use of a dryer installation as described above for drying mud or sludge.

Another aspect of the present invention provides use of a dryer installation as described above for drying waste water.

Still another aspect of the present invention provides a method for drying a product. The method comprises following steps: first a device for moving a product and at least one heating unit are provided. The heating unit comprises at least one radiant emitter and an overpressure system. The heating unit heats the moving product by radiation, the moving product thereby produces evaporation products. The heating unit is delimited by protection. This protection is transparent to infrared radiation and provides a physical barrier against the evaporation products. The overpressure system blows air into the heating unit for creating an overpressure in the heating unit. The infrared emitters produce combustion products at high temperature. The air and the combustion products are getting mixed in the heating unit thereby obtaining a mixture. The protection allows a first flow of this mixture to exit the heating unit through the protection under the driving force of the overpressure system and onto the product to be dried. The overpressure system removes the remainder in a second flow of the mixture out of the heating unit. The dryer installation further comprises an extraction means for extracting extracted products. The extracted products comprise at least part of the evaporation products and this first flow of the mixture.

In a preferred embodiment, the method further comprises a step wherein the extracted products are burned by at least one external burner.

In an even more preferred embodiment, the method further comprises a step wherein the extracted products are recirculated by a recirculating means to at least one infrared emitter in at least one heating unit.

In a further preferred embodiment, the dryer installation further comprises means for re-use at least part of the second flow of the mixture extracted by the overpressure system, wherein this second flow is used for heating the device for moving the product.

BRIEF DESCRIPTION OF DRAWINGS

Example embodiments of the invention are described hereinafter with reference to the accompanying drawings in which.

REFERENCE NUMBERS

Figure 1:
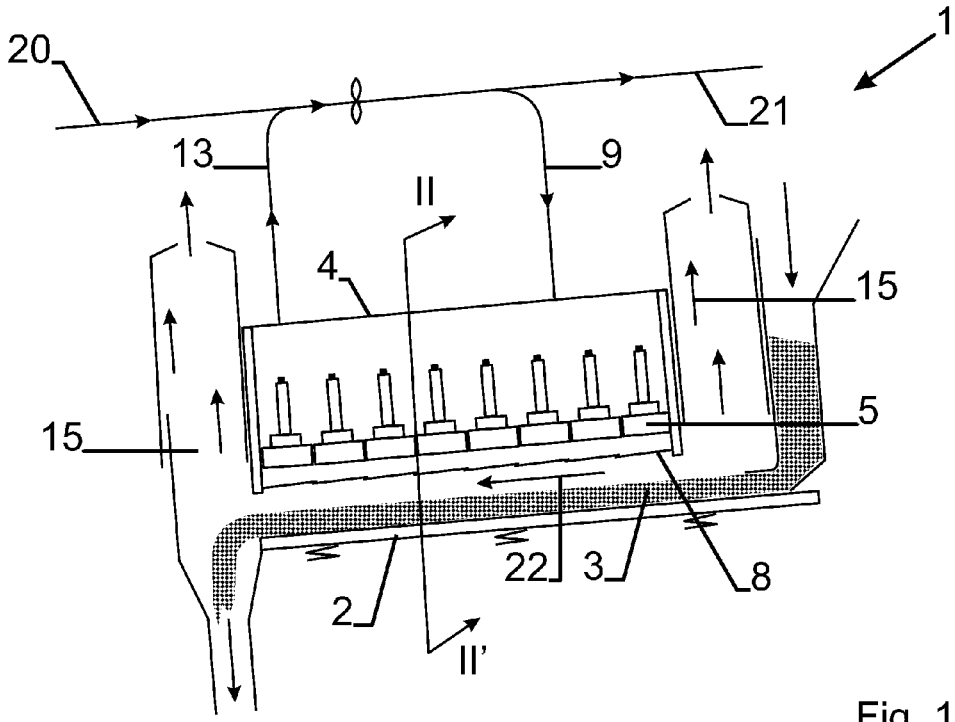
FIG. 1 shows a cross section through an example embodiment of the present invention.

1 drying installation
2 device for moving product
3 product
4 heating unit
5 infrared emitter
6 overpressure system
7 evaporation products
8 protection
9 air
10 combustion products
11 mixture of air 9 and combustion products 10
12 first flow of mixture 11
13 second flow of mixture 11
14 extraction means
15 extracted products
16 external burner
17 recirculation means
18 means for re-using second flow 13
19 recirculated extracted product 15 mixed with fresh air coming from inlet 20
20 fresh air inlet
21 exhaust
22 moving direction of the product 3
23 extraction fan

MODE(S) FOR CARRYING OUT THE INVENTION

Examples of an apparatus and methods for drying a product will now be described with reference to FIGS. 1 to 6.

FIG. 1 is a longitudinal cross section of a first exemplary embodiment according to the present invention. The dryer installation 1 is configured for drying a product 3. The dryer installation 1 comprises a device 2 for moving the product 3 and a heating unit 4. The product 3 is moving in the direction of the arrow 22. The heating unit 4 comprises a multitude of infrared emitters 5 and an overpressure system 6 (not shown).

Figure 2:
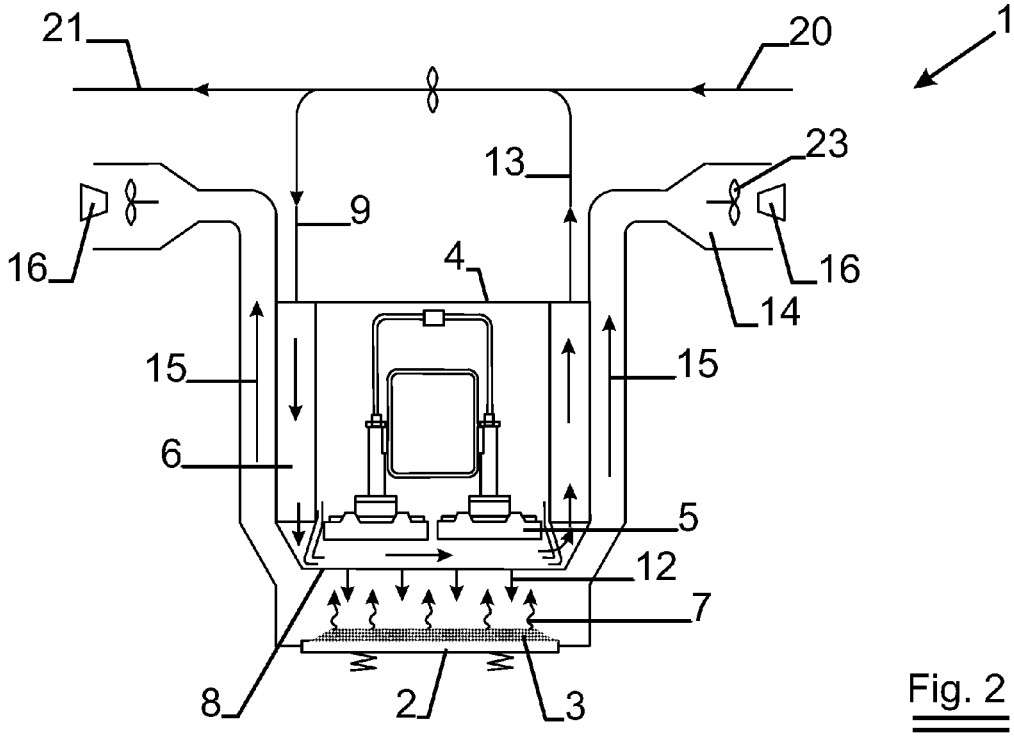
FIG. 2 shows a first embodiment of a cross section according to the line II-II' in FIG. 1.
Figure 4:
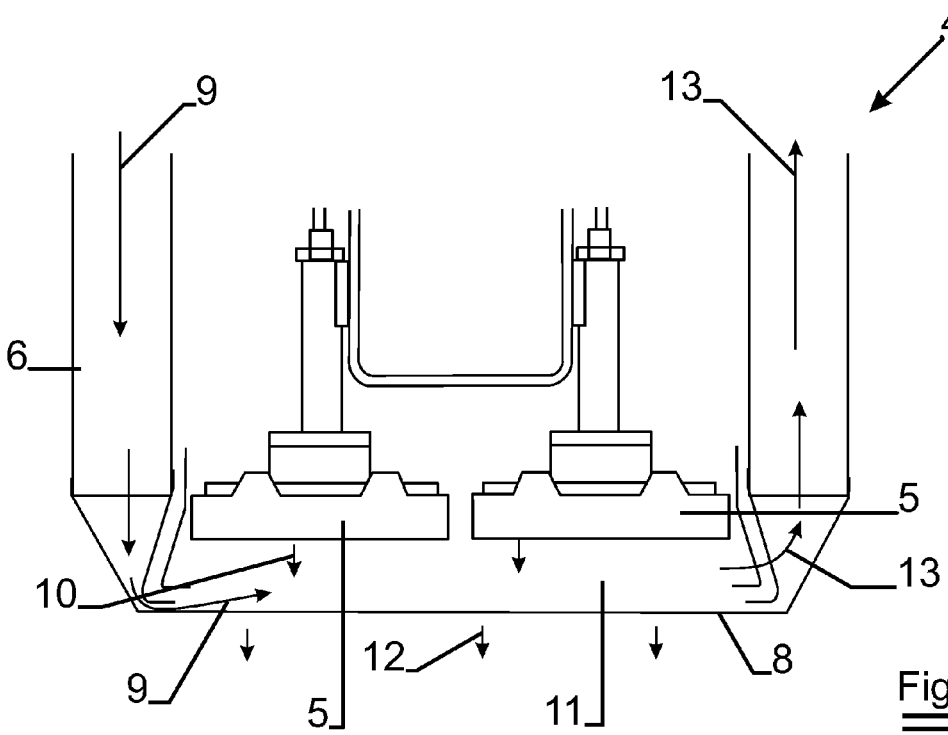
FIG. 4 shows an enlarged view of an exemplary heating unit according to the present invention.

The illustrated example of FIG. 2 shows a first embodiment of a cross section according to the line II-II' in FIG. 1. In this exemplary embodiment, there is one heating unit 4 above the device for moving product 3. The heating unit 4 comprises infrared emitters 5 and an overpressure system 6. In use, the heating unit 4 is heating the moving product 3 by radiation. By this radiation, evaporation products 7 are produced. The heating unit 4 is delimited by protection 8. The protection 8 is transparent to infrared radiation and provides a physical barrier against the evaporation products. In this example protection 8 is made of quartz glass and is constructed such that it comprises different smaller protections which are not bound in an airtight way. The overpressure system 6 is blowing air 9 into the heating unit 4 in front of the radiant emitters 5 for creating an overpressure between the emitter(s) and protection 8. The infrared emitters 5 are producing, in use, combustion products 10 at high temperature, as shown in FIG. 4. The air 9 and these combustion products 10 are getting mixed in the heating unit 4 thereby obtaining a mixture 11, as shown in FIG. 4. As shown in FIGS. 2 and 4, the protection 8 allows first flow 12 of this mixture 11 to exit the heating unit under the driving force of the overpressure system 6. The first flow 12 flows perpendicularly onto the product to be dried 3 and assists in drying via convective heat transfer. This first flow 12 is only 10% of the total amount of mixture 11. The overpressure system 6 is removing the remainder of the mixture 11 in a second flow 13 out of the heating unit 4. This air 9 is preferably at a temperature of about 200° C. which, in this example, is obtained by mixing part of the returning second flow 13 with fresh air 20 coming into the drying system. The remainder of the returning second flow 13 is then exiting the dryer installation via exhaust 21. The dryer installation 4 further comprises extraction means 14 which extracts extracted products 15. In this exemplary embodiment, the extraction means are driven by fans 23. These extracted products 15 comprise at least part of the evaporation products 7, which were produced by the heating of the product, and the first flow 12 of the mixture 11 originating from the heating unit 4. In this example, the extracted products 15 are burned by an external burner 16, e.g. a flare system as e.g. described in WO2006/010693. This is especially suitable if the product to be dried gives rise to environmental harmful evaporation products, and even aggressive and corrosive evaporation products.

Figure 3:
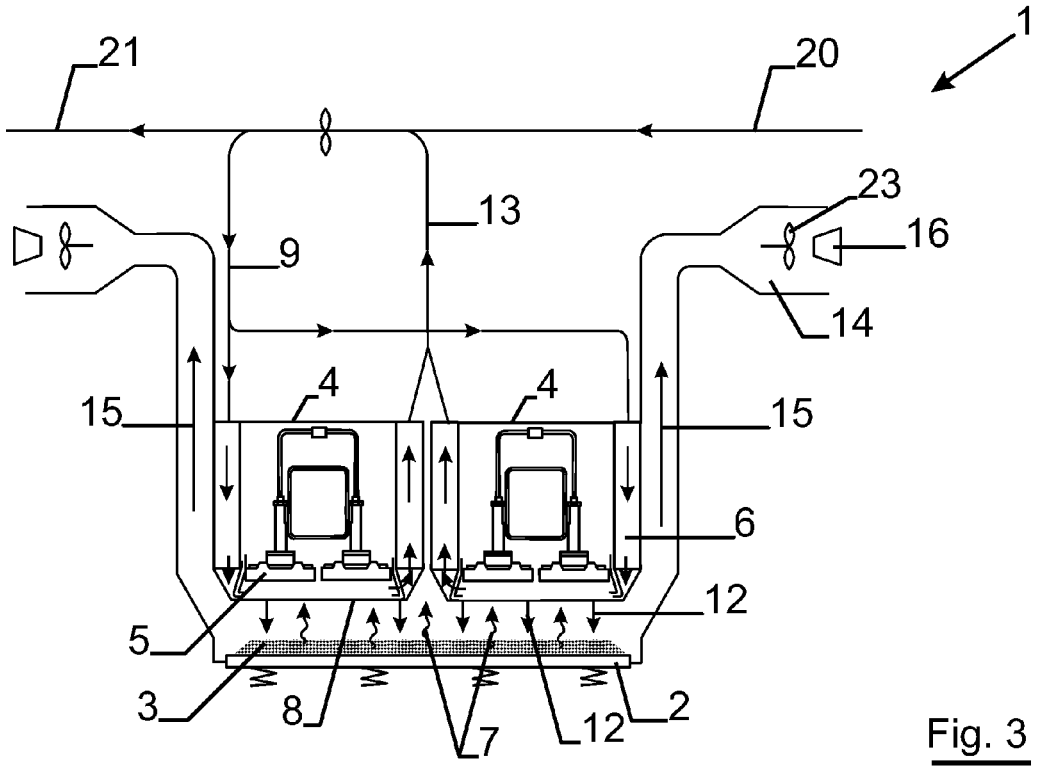
FIG. 3 shows a second embodiment of a cross section according to the line II-II' in FIG. 1.

FIG. 3 shows a second embodiment of a cross section according to the line II-II' in FIG. 1. In this exemplary embodiment, there are two heating units next to one another above the device for moving product 3.

FIG. 4 shows an enlarged view of an exemplary heating unit as described in FIG. 2. This exemplary heating unit 4 comprises rows of two radiant emitters 5 next to one another. The overpressure system 6 (which is only shown in part) is blowing air 9 into the heating unit 4 in front of the radiant emitters 5 for creating an overpressure. The infrared emitters 5 are producing, in use, combustion products 10 at high temperature. The air 9 and these combustion products 10 are getting mixed in the heating unit 4 thereby obtaining a mixture 11. The protection 8 allows a first flow 12 of this mixture 11 to exit the heating unit under the driving force of the overpressure system 6 through the protection 8. The overpressure system 6 is also removing the remainder of the mixture 11 in a second flow 13 out of the heating unit 4.

Figure 5:
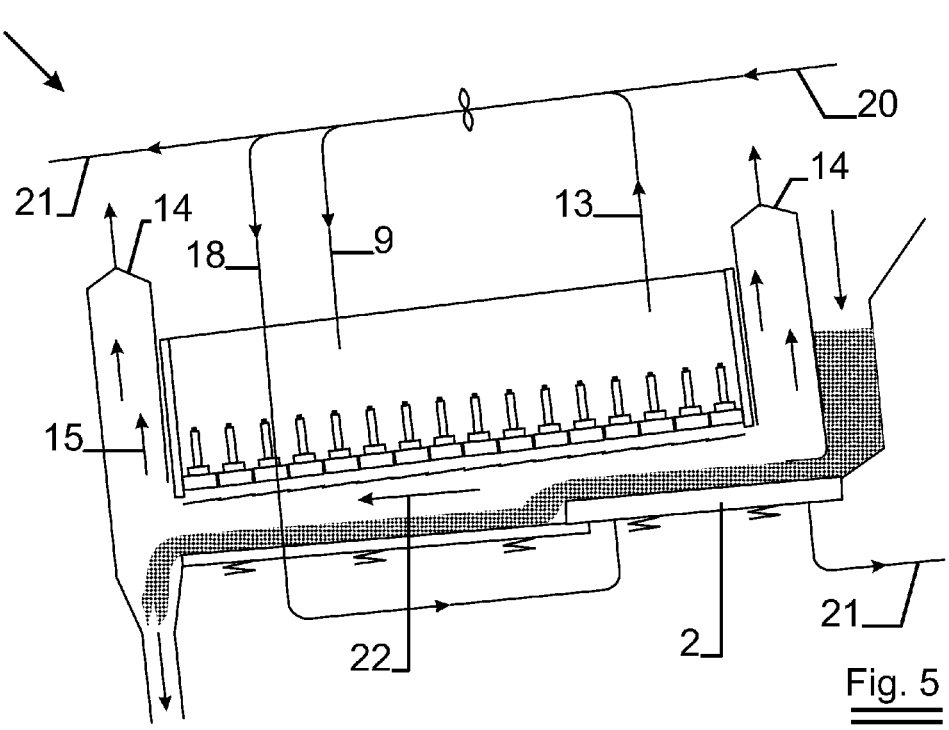
FIG. 5 shows a cross section of a further exemplary embodiment according to the present invention.

FIG. 5 shows a longitudinal cross section of a further exemplary embodiment according to the present invention. In this example, the dryer installation 1 further comprises means 18 for re-using at least part of the second flow 13 of the mixture 11 removed by the overpressure system for heating at least part of the device 2 for moving the product. This is a further increase of the efficiency by the re-use of the hot flux gas. In this example, this heating is done in the first part of the device 2 for moving the product 3 (in this example the device 2 is composed of two vibrating plates wherein the first one is heated by the re-used second flow), as there the product will contain still a lot of fluid which needs to be evaporated.

Figure 6:
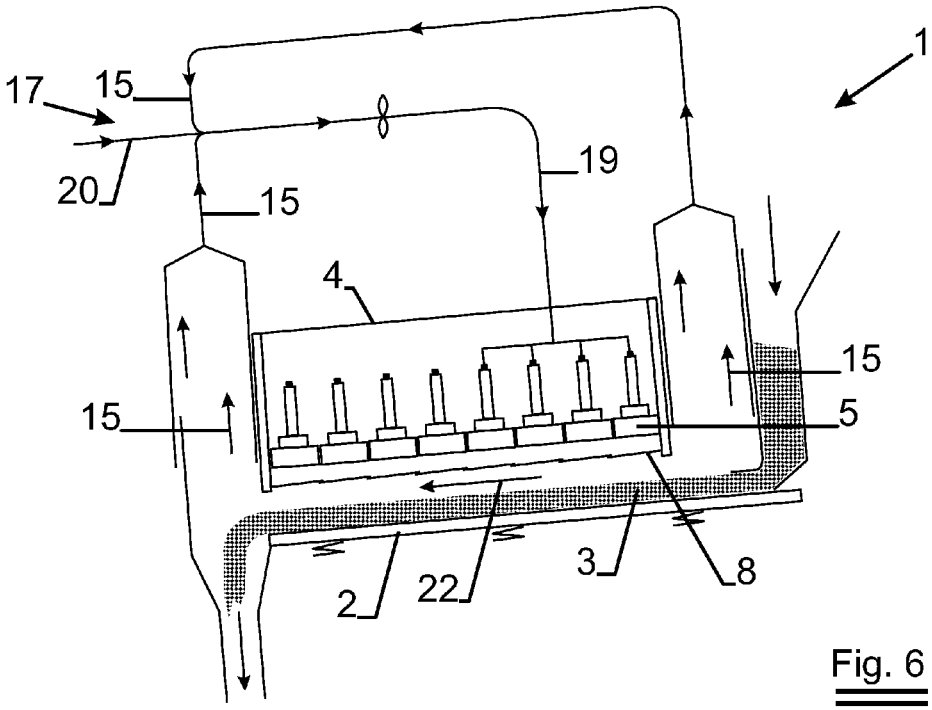
FIG. 6 shows a cross section of another further exemplary embodiment according to the present invention.

FIG. 6 shows a longitudinal cross section of another exemplary embodiment according to the present invention. In this example, the dryer installation 1 further comprises a recirculation means 17 for providing the extracted products 15 to at least one infrared emitter 5 in at least one heating unit 4. The recirculated extracted products 15 are mixed with fresh air coming from air inlet 20 and form a gas flow 19. The heat treatment of the evaporation products 7 in the extracted products 15 is then performed by the drying installation itself by at least part of the radiant emitters 5. The other emitters are then fed by municipal gas or biogas as explained above. The heat generated by combustion of the evaporation products is thus also used to heat the product to be dried. This lowers the amount of heat exposed to the environment and at the same time the toxic evaporation products are converted to harmless combustion products, such as e.g. $CO_2$ and $H_2O$. In case of aggressive and/or corrosive extraction products, the emitters used to burn off the extracted products are adapted for receiving such aggressive and/or corrosive products.

Thus there has been described a drying installation and method for drying of products. More in particular, the invention relates to a drying installation and a method for drying sludge or mud, as e.g. the drying of wastewater and industrial sludge possibly contaminated with toxic or corrosive components. The dryer installation comprises infrared emitters which are protected and/or insulated from the evaporation products exiting the drying product. This provides a longer lifetime of the drying installation.

The invention claimed is:

1. A dryer installation (1) for drying a product (3), said dryer installation comprising:

a device (2) for moving the product (3);

at least one heating unit (4), said heating unit comprising at least one infrared emitter (5) and an overpressure system (6);

said heating unit (4) adapted for heating by radiating said moving product (3), thereby obtaining evaporation products (7);

said at least one heating unit (4) being delimited by protection (8);

said protection (8) being transparent to infrared radiation and providing a physical barrier against said evaporation products (7);

said overpressure system (6) being adapted for blowing air (9) into said heating unit (4) for creating an overpressure in the heating unit (4);

said infrared emitters (5) adapted for producing combustion products (10) at high temperature;

said air (9) and said combustion products (10) getting mixed in the heating unit thereby obtaining a mixture (11);

said protection (8) being adapted for allowing a first flow (12) of said mixture (11) to exit the heating unit (4) through said protection (8) onto the product (3) to be dried;

said overpressure system (6) being adapted for removing a second flow (13) of said mixture (11) out of the heating unit (4);

said dryer installation further comprising:

an extraction means (14) being adapted for extracting extracted products (15), said extracted products (15) comprising at least part of said evaporation products (7) and said first flow (12) of said mixture (11).

2. A dryer installation as in claim 1, said dryer installation further comprising at least one external burner (16) adapted to burn said extracted products (15).

3. A dryer installation as in claim 1, said dryer installation further comprising recirculation means (17) adapted for providing said extracted products (15) to at least one infrared emitter (5) in at least one heating unit (4).

4. A dryer installation (1) as in claim 1, wherein said heating unit (4) comprises gas infrared emitters.

5. A dryer installation (1) as in claim 1, wherein said dryer installation further comprises means (18) adapted for re-using at least part the second flow (13) of said mixture (11) extracted by said overpressure system (6) for heating said device (2).

6. Use of a dryer installation as in claim 1, for drying mud or sludge.

7. Use of a dryer installation as in claim 1, for drying waste water.

8. A method for drying a product (3), said method comprising following steps:

providing a device (2) for moving a product (3);

providing at least one heating unit (4), said heating unit comprising at least one radiant emitter and an overpressure system;

said heating unit (4) heating said moving product (3) by radiation;

said moving product thereby producing evaporation products (7);

said heating unit (4) being delimited by protection (8);

said protection (8) being transparent to infrared radiation and providing a physical barrier against said evaporation products (7);

said overpressure system (6) blowing air (9) into the heating unit (4) for creating an overpressure in the heating unit (4), said infrared emitters producing combustion products (10) at high temperature, said air (9) and said combustion products (10) getting mixed in the heating unit thereby obtaining a mixture (11)

said protection (8) allowing a first flow (12) of said mixture (11) to exit the heating unit (4) through said protection (8) onto the product (3) to be dried;

said overpressure system (6) removing a second flow (13) of said mixture (11) out of the heating unit (4);

said dryer installation further comprising:

an extraction means (14) for extracting extracted products (15), said extracted products (15) comprising at least part of said evaporation products (7) and said first flow (12) of said mixture (11).

9. A method for drying a product as in claim 8, wherein said extracted products (15) are burned by an external burner (16).

10. A method for drying a product as in claim 8, said dryer installation (1) further comprising a recirculation means (17) for providing said extracted products (15) to at least one infrared emitter (5) in at least one heating unit (4).

11. A method for drying a product as in claim 8, said dryer installation (1) further comprising means (18) for re-using at least part of the second flow (13) of said mixture (11) extracted by said overpressure system (6) for heating said device (2).

12. A method for drying a product as in claim 10, said dryer installation (1) further comprising means (18) for re-using at least part of the second flow (13) of said mixture (11) extracted by said overpressure system (6) for heating said device (2).

* * * * *